United States Patent [19]

Ellis

[11] Patent Number: 5,041,142

[45] Date of Patent: Aug. 20, 1991

[54] PEROXYMETALLATES AND THEIR USE AS BLEACH ACTIVATING CATALYSTS

[75] Inventor: Simon R. Ellis, Edgewater, N.J.

[73] Assignee: Lever Brothers Company, Division of CONOPCO, Inc., New York, N.Y.

[21] Appl. No.: 498,311

[22] Filed: Mar. 23, 1990

[51] Int. Cl.[5] ..... D06L 3/02; D06L 3/04

[52] U.S. Cl. ..... 8/111; 8/101; 8/107

[58] Field of Search ..... 252/186.39, 186.26, 252/186.3, 186.31; 8/107, 111

[56] References Cited

U.S. PATENT DOCUMENTS 3,532,634 10/1976 Woods ..... 252/95

FOREIGN PATENT DOCUMENTS 0179664 4/1986 European Pat. Off. .
2106975 4/1972 France .
2187774 6/1972 France .

OTHER PUBLICATIONS

Rucker et al., Tex Res. J., 58003:148–160 (1988).

Mimoun et al., Tetrahedron, 26:37–50 (1970).

*Primary Examiner*—Paul Lieberman
*Assistant Examiner*—John F. McNally
*Attorney, Agent, or Firm*—Ronald A. Koatz

[57] ABSTRACT

The subject invention relates to bleaching compositions comprising novel peroxymetallate bleach activators. The bleaching compositions comprise:

(i) from about 1 to 60% of a peroxygen compound capable of yielding hydrogen peroxide in an aqueous solution; and (ii) from about 0.1 to about 30% of a bleach activator having the formula:

$$MO_5(XR)(X_1R_1)$$

wherein M is molybdenum or tungsten; X and $X_1$ are donor groups having available at least one pair of electrons; and R and $R_1$ are each a radical selected from the group consisting of hydrogen, alkyl, aryl, alkylaryl, arylalkyl, phenyl, benzyl, and mixtures thereof.

16 Claims, No Drawings

PEROXYMETALLATES AND THEIR USE AS BLEACH ACTIVATING CATALYSTS

BACKGROUND OF THE INVENTION

1. Field of the Invention

The invention relates to novel bleach activators, bleaching compositions containing these activators, and to a method of bleaching laundry fabrics using a composition comprising these novel bleach activators.

2. Prior Art

Active oxygen-releasing compounds are well known as effective bleaching agents. These compounds are frequently incorporated into detergent compositions for stain and soil removal. Unlike the traditional sodium hypochlorite, hydrogen peroxide-releasing compounds are less aggressive and thus more compatible with the ingredients of detergent compositions. On the other hand, the bleaching activity of these compounds is highly temperature dependent. Use of hydrogen peroxide releasing bleaches is only practical where the wash temperatures are above 60° C. Below this temperature, extremely high amounts of the active oxygen-releasing compound must be added to achieve the desired result. Frequently, wash temperatures are, however, on the low side for various reasons including that of energy efficiency.

The temperature problem can be solved by use of transition metal containing compounds which catalyze or activate the oxygen-releasing material, even at relatively low temperatures. Typical metals known in the art include those of iron, cobalt, manganese and copper. Only select transition metal substances provide the efficient catalysis necessary for laundry fabrics application at these temperatures. Furthermore, not all types of stains are removable by the transition metal-hydrogen peroxide generated substances. Especially difficult to bleach are hydrophobic stains such as those caused by spaghetti sauce and the like.

It is known in the art that peroxygen compounds (i.e., peracetic acid) may act as effective bleaching agents when combined with polypyridine chelating agents in the presence of transition metal cations having atomic number 24–29 (i.e., Cr, Mn, Fe, Co, Ni or Cu) at temperatures as low as 49° C. (U.S. Pat. No. 3,532,634). It is also known that no transition metal need be added and bleaching can be obtained at temperatures as low as 30° C. when certain pyridine chelators (i.e., 2,2'-bipyridine) are added to a bleaching solution containing peracetic acid. Rucker et al, Tex. Res. J., 58003: 148–160 (1988). No transition metal cations need be added because these cations are naturally present in the scoured cotton fibers which are bleached as taught by this reference. Neither of these references teaches the use of molybdenum or tungsten complexes as bleach activators.

Peroxometallate compounds (wherein the metal is molybdenum or tungsten) are known to catalyze the reaction of peroxide with alkenes and alcohols, i.e., functionalities commonly found in stains. (Minoun et al, Tetrahedron, 26: 37–50 (1970); French Publication No. 2187774 (Minoun et al);French Publication No. 2106975 (Barrat et al); European Publication No. 0179664 (Atlantic Richfield Co.)). However, these compounds have not been previously used as stain removal catalysts against complex polyalkene or polyalcohol stains.

Thus it would be useful to find a novel class of stain removal catalysts to be used in laundry fabric cleaning. Moreover, it would be useful if the stain removal catalyst could be readily modified (e.g., by choice of ligating group) to affect the efficiency of the catalyst.

SUMMARY OF THE INVENTION

The subject invention provides a bleaching composition comprising:

(i) from about 1 to 60% of a peroxygen compound capable of releasing hydrogen peroxide in an aqueous solution; and (ii) from about 0.1 to about 30% of a bleach activator having the formula:

$$MO_5(XR)(X_1R_1)$$

wherein M is molybdenum or tungsten; X and $X_1$ are donor groups having available at least one lone pair of electrons; and R and $R_1$ are the same or different ligands capable of conferring different degrees of hydrophobicity or hydrophillicity on the peroxometallate compound.

In particular, the greater the degree of hydrophillicity (lower log P) of the ligand, the better the bleaching performance of the metallate complex.

Preferably, at least one of the two electron donor groups (X and $X_1$) is a heterocyclic nitrogen or a carbonyl-containing group.

R and $R_1$ are each a radical selected from the group consisting of hydrogen, alkyl, aryl, alkylaryl, arylalkyl, phenyl, benzyl, and mixtures thereof.

XR may be the same or different from $X_1R_1$ and may be a more hydrophillic entity such as dimethylformamide ($XR=X_1R_1$) or cholyl pyridine carboxylate (cpc); or a less hydrophillic entity such as pyridine or ethylpyridine. $X_1R_1$, if it is not the same as XR, is generally $H_2O$.

The invention is also directed to a method of bleaching laundry fabrics that involves contacting fabrics with an aqueous or non-aqueous solution of the peroxygen compound and the metallate complex.

DETAILED DESCRIPTION OF THE INVENTION

A series of peroxometallate complexes have been found to perform as activators promoting the release of hydrogen peroxide from peroxygen compounds. These complexes are characterized by the following formula:

$$MO_5(XR)(X_1R_1)$$

wherein M is molybdenum or tungsten, X and $X_1$ are donor groups having available at least one lone pair of electrons; and R and $R_1$ are each a radical selected from the group consisting of hydrogen, alkyl, aryl, alkylaryl, arylalkyl, phenyl, benzyl, water and mixtures thereof. X and $X_1$ should be resistant to oxidation and should preferably be selected from heterocyclic nitrogen compounds, compounds having a carbonyl or carboxylic acid donor groups or from compounds having an alcohol donor group.

Most preferred complexes are as follows:

$XR=X_1R_1$=dimethylformamide (bis(dimethylformamide)diperoxomonooxo-molybdenum(VI));

XR=pyridine and $X_1R_1=H_2O$ ((pyridine)(diperoxomonoxo-molybdenum (VI)hydrate);

XR=ethylpyridine and $X_1R_1=H_2O$ (bis(4-ethylpyridine)diperoxomonooxo-molybdenum(VI));

XR=cholyl pyridine carboxylate (cpc) and $X_1R_1=H_2O$ (4-cholylpyridinecarboxylatediperoxomonooxo molybdenum VI));

Typically, the peroxomometallate complexes will catalyze the reaction of peroxides with various alkenes and alcohols in solution.

In addition to the degree of hydrophilicity of the ligand groups (as measured by log P), other factors which may impact on the bleach catalysis performance of the catalyst complexes include pH of the solution, temperature, and concentration of complex relative to substrate. Whether the substrate is an alcohol or an alkene may also have some bearing on bleach catalysis.

More particularly, the peroxometallate complexes of the invention have been shown to increase the bleaching activity of peroxide bleaches relative to the peroxide alone. The complexes show enhanced activity when used on Ragu extract (alkene functionality) compared to hydrogen peroxide (Example 3).

The complexes of the invention may be reacted in aqueous or non-aqueous solutions and solvents may be used to dissolve the complexes into solution.

The pH and concentration of the metal complex of the solution may also effect the catalytic activity of the complex. pH may range from 7–11, preferably 7–9, most preferably 7.5–8.5. The concentration of complex may vary from 3–10 mM, preferably 4–8 mM, most preferably 4–6 mM.

As discussed above, the hydrophobic or hydrophillic ratio of the ligand group also may have an effect on catalytic activity. It has been found that those complexes containing ligands having the lowest log P (i.e., which are most hydrophillic) show greater catalytic activity.

Finally, temperature may also have an effect on catalytic activity. Bleaching temperature should range from 10°–40° C., preferably 20°–30° C., most preferably 22°–28° C.

The foregoing catalysts may be incorporated into detergent bleach compositions which require as an essential component a peroxygen bleaching compound capable of releasing hydrogen peroxide in an aqueous solution.

Hydrogen peroxide sources are well known in the art. They include the alkali metal peroxides, organic peroxide bleaching compounds, such as the alkali metal perborates, percarbonates, perphosphates and persulfates. Mixtures of two or more such compounds may also be suitable. Particularly preferred are sodium perborate tetrahydrate and, especially, sodium perborate monohydrate. Sodium perborate monohydrate is preferred because it has excellent storage stability while also dissolving very quickly in aqueous bleaching solutions.

Typically, the ratio of peroxygen compound, on a hydrogen peroxide molar release basis, to that of the metal complex will range from about 50:1 to 1:20, preferably from about 20:1 to 1:10, optimally between about 5:1 to 1:1.

A detergent formulation containing a bleach system consisting of an active oxygen releasing material and a novel activator (catalyst) compound of the invention will usually also contain surface-active materials, detergency builders and other known ingredients of such formulations.

The surface-active materials may be naturally derived, such as soap, or a synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Pery and Berch. The total level of the surface-active material may range up to 50% by weight, preferably being from about 1% to 40% by weight of the composition, most preferably 4 to 25%.

Synthetic anionic surface-actives are usually water-soluble alkali metal salts of organic sulphates and sulphonates having alkyl radicals containing from about 8 to about 22 carbon atoms, the term alkyl being used to include the alkyl portion of higher aryl radicals.

Examples of suitable synthetic anionic detergent compounds are sodium and ammonium alkyl sulphates, especially those obtained by sulphating higher ($C_8$–$C_{18}$) alcohols produced for example from tallow or coconut oil; sodium and ammonium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and ammonium salts of sulphuric acid esters of higher ($C_9$–$C_{18}$) fatty alcohol-alkylene oxide, particularly ethylene oxide, reaction products; the reaction products of fatty acids such as coconut fatty acids esterified with isethionic acid and neutralized with sodium hydroxide; sodium and ammonium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolyzing with a base to produce a random sulphonate; sodium and ammonium $C_7$–$C_{12}$ dialkyl sulfosuccinates; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkylbenzene sulphonates, sodium ($C_{16}$–$C_{18}$) alkyl sulphates and sodium ($C_{16}$–$C_{18}$) alkyl ether sulphates.

Examples of suitable nonionic surface-active compounds which may be used, preferably together with the anionic surface-active compounds, include in particular the reaction products of alkylene oxides, usually ethylene oxide, with alkyl ($C_6$–$C_{22}$) phenols, generally 5–25 EO, i.e. 5–25 units of ethylene oxides per molecule; the condensation products of aliphatic ($C_8$–$C_{18}$) primary or secondary linear or branched alcohols with ethylene oxide, generally 6–30 EO, and products made by condensation of ethylene oxide with the reaction products of propylene oxide and ethylene diamine. Other so-called nonionic surface-actives include alkyl polyglycosides, long chain tertiary amine oxides, long chain tertiary phosphine oxides and dialkyl sulphoxides.

Amounts of amphoteric or zwitterionic surface-active compounds can also be used in the compositions of the invention but this is not normally desired owing to their relatively high cost. If any amphoteric or zwitterionic detergent compounds are used, it is generally in small amounts in compositions based on the much more commonly used synthetic anionic and nonionic actives.

Soaps may also be incorporated into the compositions of the invention, preferably at a level of less than 30% by weight. They are particularly useful at low levels in binary (soap/anionic) or ternary mixtures together with nonionic or mixed synthetic anionic and nonionic compounds. Soaps which are used are preferably the sodium, or less desirably potassium, salts of saturated or unsaturated $C_{10}$–$C_{24}$ fatty acids or mixtures thereof. The amount of such soaps can be varied between about 0.5% and about 25% by weight, with lower amounts of about 0.5% to about 5% being generally sufficient for lather control. Amounts of soap between about 2% and about 20%, especially between about 5% and about 15%, are used to give a beneficial effect on detergency. This is particularly valuable in compositions used in hard water where the soap acts as a supplementary builder.

The detergent compositions of the invention will normally also contain a detergency builder. Builder materials may be selected from (1) calcium sequestrant materials, (2) precipitating materials, (3) calcium ion-exchange materials and (4) mixtures thereof.

Examples of calcium sequestrant builder materials include alkali metal polyphosphates, such as sodium tripolyphosphate; nitrilotriacetic acid and its water-soluble salts; the alkali metal salts of carboxymethyloxy succinic acid, ethylene diamine tetraacetic acid, oxydisuccinic acid, mellitic acid, benzene polycarboxylic acids, citric acid; and polyacetalcarboxylates as disclosed in U.S. Pat. Nos. 4,144,225 and 4,146,495.

Examples of precipitating builder materials include sodium orthophosphate, sodium carbonate and long-chained fatty acid soaps.

Examples of calcium ion-exchange builder materials include the various types of water-insoluble crystalline or amorphous aluminosilicates, of which zeolites are the best known representatives.

These builder materials may be present at a level of, for example, from 5 to 80% by weight, preferably from 10 to 60% by weight.

When the peroxygen compound and bleach activator are dispersed in water, hydrogen peroxide is generated which should deliver from about 0.1 to about 50 ppm active oxygen per liter of water; preferably oxygen delivery should range from 2 to 30 ppm. Metal complex measured as metal ion concentration should be present in the wash water in an amount from about 1 to 1000 parts per million (ppm), preferably 200–700 ppm, and most preferably 300–600 ppm. Surfactant should be present in the wash water from about 0.05 to 1.0 grams per liter, preferably from 0.15 to 0.20 grams per liter. When present, the builder amount will range from about 0.1 to 3.0 grams per liter.

Apart from the components already mentioned, the detergent compositions of the invention can contain any of the conventional additives in the amounts in which such materials are normally employed in detergent compositions. Examples of these additives include lather boosters such as alkanolamides, particularly the monoethanolamides derived from palmkernel fatty acids and coconut fatty acids; lather depressants such as alkyl phosphates and silicates; anti-redeposition agents such as sodium carboxymethylcellulose and alkyl or substituted alkylcellulose ethers; other stabilizers such as ethylene diamine tetraacetic acid; fabric softening agents; inorganic salts such as sodium sulphate; and usually present in very small amounts, fluorescent whitening agents, perfumes, enzymes such as proteases, cellulases, lipases and amylases, germicides and colorants.

The bleach compositions and activators described herein are useful in a variety of cleaning products. These include laundry detergents, laundry bleaches, hard surface cleaners, toilet bowl cleaners, automatic dishwashing compositions, denture cleaners and use in textile bleaching and pulp bleaching. Activators of the present invention can be introduced in a variety of product forms including powders, on sheets or other substrates, in pouches, in tablets or in non-aqueous liquids such as liquid nonionic detergents.

The following examples will more fully illustrate the embodiments of this invention. All parts, percentages and proportions referred to herein in the appended claims are by weight unless otherwise illustrated.

EXAMPLE 1

Analysis of Complexes

The route chosen to the $MO_5(XR)(X_1R_1)$ complex (M=Mo, W) was that of Mimoun et al, Bull de la Soc. Chimique de France, No. 5:1481–1492 (1969), which is based on the reaction of the metal trioxide with hydrogen peroxide followed by precipitation with the ligand. This reference is hereby incorporated by reference into the subject application. The following complexes were synthesized:

| Complex | Yield % | log P Ligand | Analysis C | H | N |
|---|---|---|---|---|---|
| $MoO_5(dmf)_2$ | 17 | −0.6 | 22.4 | 4.4 | 8.7 |
| | | | 21.4 | 4.3 | 8.4 |
| $MoO_5(C_5H_5N)(H_2O)$ | 70 | 0.64 | 22.0 | 2.6 | 5.1 |
| | | | 21.4 | 2.8 | 4.7 |
| $MoO_5(C_2H_5C_5H_4N)_2$ | 65 | 1.74 | 43.1 | 4.6 | 7.7 |
| | | | 40.4 | 4.4 | 6.6 |
| $MoO_5$ | 69 | −3.4 | 30.1 | 4.3 | 6.3 |
| $(Me_3N^+CH_2CH_2C(O)OC_5H_4N)$ | | | 31.3 | 4.2 | 6.5 |
| $(H_2O)Cl^-$ | | | | | |
| $WO_5(C_5H_5N)(H_2O)$ | 25 | 0.64 | 16.6 | 1.9 | 3.9 |
| | | | 16.6 | 2.2 | 3.8 |

In the case of the ethylpyridine complex the carbon analysis is believed to be low due to incorporation of water in the sample. The yield in the case of the dmf (dimethylformanide) complex is low due to the inefficient precipitation of this complex.

EXAMPLE 2

Synthesis of Complexes

The compounds of the invention were synthesized as noted below.

Synthesis of (pyridine)diperoxomonooxo-molybdenum(VI)hydrate

Molybdenum trioxide (5 g) was slurried in hydrogen peroxide (50 ml, 30%) over night at 40° C. until a yellow solution was produced. The solution was filtered and then pyridine (2 equivalents vs Mo) was added. The solution was refrigerated and the resultant precipitate recovered by filtration and dried in vacuo. The resultant product contained only one equivalent of pyridine.

Synthesis of bis(dimethylformamide)diperoxomonooxo-molybdenum(VI)

This was synthesized according to the method outlined above except that dmf was added instead of pyridine and the solution refrigerated for several days in order to obtain the product.

Synthesis of bis(4-ethylpyridine)diperoxomonooxo-molybdenumVI

This was synthesized by an alalogous route to that used for the pyridine complex except that the complex precipitated instantly.

Synthesis of 4-cholylpyridinecarboxylatediperoxomonooxomolybdenumVI chloride hydrate The ligand was prepared by condensing isonicotinyl chloride and choline chloride in acetonitrile under reflux. Isonicotinyl chloride (5.6 g) was refluxed in acetonitrile (500 ml). Choline chloride (4.4 g) was added and the solution refluxed for two hours, the product was recovered by filtration and dried in vacuo. The molybdenum complex was synthesized in a manner analogous to that for the pyridine except that only one equivalent of ligand was added.

Synthesis of ovridinediperoxomonooxotunostenVI hydrate

This complex was synthesized in an analogous manner to the molybdenum complex except that tungsten trioxide was the starting material.

EXAMPLE 3

Evaluation of Reactivity with Ragu Extract in Solution

In order to assess the potential of these complexes as catalysts their effect on the reaction of Ragu stain and hydrogen peroxide was determined. The reaction was monitored by UV/Vis spectroscopy. The results are summarized below:

| Metal | Ligand | Change Abs 480 nm Time = 100 secs |
|---|---|---|
| Mo | pyridine | 0.05 |
| | dmf | 0.06 |
| | Etpyridine | 0.02 |
| | cpc | 0.03 |
| W | pyridine | 0.06 |

In all cases the rate of reaction is increased by addition of the complex. The results above are corrected to take account of the effect of hydrogen peroxide alone. The molybdenum complexes show a similar reactivity which is to be expected since the different hydrophobicities of the ligands would not be expected to have a marked effect on the reactivity in organic solvent.

Data on the Ragu extract clearly shows that novel molybdenum and tungsten complexes may readily be used to catalyze bleaching reactions wherein the stain substrate has a complex polyalkene functionality.

EXAMPLE 4

Catalytic Effect of Peroxometallate complexes on Tea Stained Clothes

Effect of pH

The bleaching profile for the peroxomolybdates was studied over the pH range 5–10 and found to be optimized at pH 8 for 5 mM complex/25° C. The maximum ΔΔR is 4.5 for the molybdenum cholyl pyridine carboxylate complex. The data for the complexes is set forth in Table 1 below.

TABLE 1

ΔΔR Values for Peroxomolybdenum Complexes at Room Temperature
5 mM Complex and 10 mM Hydrogen Peroxide, 2 h

| Complex | pH 8 | pH 9 | pH 10 | log P |
|---|---|---|---|---|
| $MoO_5(cpc)(H_2O)^a$ | 4.5 | 2.0 | 3.9 | −3.4 |
| $MoO_5(pyridine)(H_2O)^b$ | 2.4 | 0.5 | −3.8 | 0.64 |
| $MoO_5(DMF)_2$ | 3.2 | 1.1 | −1.7 | −0.6 |
| $MoO_5(EtPyr)_2{}^b$ | 2.2 | −0.5 | −2.7 | 1.74 |

[a]DMF added to get complex into solution
[b]MeOH/MeCN added to get complexes into solution.
ΔR = Reflectance value ([Mo] + [$H_2O_2$] + [substrate])
ΔΔR = Reflectance value ([Mo] + [$H_2O_2$] + [substrate]) − Reflectance value ([$H_2O_2$] + [substrate])

Bleaching is generally indicated by an increase in reflectance (e.g., as measured on a Colorgard system/O5 reflectometer), reported as ΔR. If the substrate is a tea stain, as in the present example, the reflectance value is typically measured on a tea-stained cloth or BC-1 cloth. Thus, change in reflectance on the tea-stained cloth is measured as change in BC-1 units. Of course, as defined above, the difference in reflectance value of a tea-stained cloth washed with a molybdenum complex and $H_2O_2$ versus a tea-stained cloth washed with $H_2O_2$alone is measured as ΔΔR and this can also be measured in BC-1 units.

As noted, the two most hydrophilic complexes (based on the log P of the ligands, i.e. the lower the log P, the more hydrophillic), give rise to the best performance (greater R equals better performance). This suggests that log P can be used for the complexes to give an indication of stain bleaching. The low results observed at pH 10 are partly due to the relatively high background values obtained for the solvent plus peroxide control. It is necessary to add a solvent to these systems to get them into aqueous solution. Results quoted are for the solvent system which gave the highest ΔΔR value for the dmf, pyridine and ethylpyridine complexes. The solvent used for these complexes was a methanol/acetonitrile mix; use of dmf lowered the ΔΔR values by ~1 BC-1 unit for these complexes.

From this data, it is clear that catalytic effect for the complexes of the invention may be obtained in solutions having a pH ranging from 7–11, more preferably 7–9, most preferably 7.5–8.5.

Effect of Temperature

In almost all cases increasing the temperature of bleaching from 25° C. to 40° C. results in a change from a positive to a negative ΔΔR value. This is due to two factors. Firstly, the increased temperature results in an increased control ΔR value and at the increased temperature hydrogen peroxide decomposition by these complexes rises dramatically. Thus, preferred temperature ranges of invention are 10°–40° C., preferably 20°–30° C., most preferably 22°–28° C.

Effect of Concentration

Decreasing the concentration of the cationic molybdenum complex from 5 mM to 0.5 mM in resulted in a reduction of bleaching from 4.5 BC-1 units to 2.1 units.

I claim:

1. A bleaching composition comprising:

(i) from about 1 to 60% of a peroxygen compound capable of yielding hydrogen peroxide in an aqueous solution; and (ii) from about 0.1 to about 30% of a bleach activator having the formula:

$MO_5(XR)(X_1R_1)$ wherein M is molybdenum or tungsten; X and $X_1$ are donor groups having available at least one lone pair of electrons; and R and $R_1$ are each a radical selected from the group consisting of hydrogen, alkyl, aryl, alkylaryl, arylalkyl, phenyl, benzyl, and mixtures thereof.

2. A composition according to claim 1, wherein X and $X_1$ are selected from the group consisting of heterocyclic nitrogen compounds, compounds having a carbonyl or carboxylic acid donor group and compounds having an alcohol donor group.

3. A composition according to claim 1, wherein at least one of X and $X_1$ is a heterocyclic nitrogen or a carbonyl containing compound.

4. A composition according to claim 1, wherein the bleach activator is bis(dimethylformamide)diperoxomonooxo-molybdenum(VI)

5. A composition according to claim 1, wherein the bleach activator is (pyridine)(diperoxomonooxo-molybdenum(VI) hydrate.

6. A composition according to claim 1, wherein the bleach activator is bis(4-ethylpyridine)diperoxomonooxomolybdenum(VI).

7. A composition according to claim 1, wherein the bleach activator is 4-cholyl pyridinecarboxylate diperoxomonooxomolybdenum(VI).

8. A claim according to claim 1 wherein the bleach activator is dissolved in an aqueous solution using an organic solvent.

9. A composition according to claim 1 additionally comprising a bleach substrate.

10. A composition according to claim 1, wherein the pH of the composition is from about 7–11.

11. A composition according to claim 1, wherein the concentration of bleach activator is from about 3–10 mM.

12. A composition according to claim 1, wherein the peroxygen compared is selected from the group consisting of sodium perborate tetrahydrate, sodium perborate monohydrate and mixtures thereof.

13. A composition according to claim 1 further comprising 1 to 40% of a surfactant and from 5 to 80% of a detergent builder.

14. A composition according to claim 1 further comprising at least one enzyme.

15. A method for bleaching fabrics comprising suspending said fabrics in an aqueous wash solution along with a peroxygen compound capable of yielding hydrogen peroxide and a bleach activator having the formula:

$MO_5(XR)(X_1R_1)$ wherein M is molybdenum or tungsten; X and $X_1$ are donor groups having available at least one lone pair of electrons; and R and $R_1$ are each a radical selected from the group consisting of hydrogen, alkyl, aryl, alkylaryl, arylalkyl, phenyl, benzyl, and mixtures thereof.

16. The method according to claim 15, wherein the temperature is from about 10°–40° C.

* * * * *